United States Patent [19]

Scholz

[11] Patent Number: 4,644,366

[45] Date of Patent: Feb. 17, 1987

[54] MINIATURE RADIO TRANSCEIVER ANTENNA

[75] Inventor: Frederick J. Scholz, Fremont, Calif.

[73] Assignee: Amitec, Inc., San Carlos, Calif.

[21] Appl. No.: 655,046

[22] Filed: Sep. 26, 1984

[51] Int. Cl.[4] ..... H01Q 1/12; H01Q 1/36

[52] U.S. Cl. ..... 343/895; 343/702; 343/748

[58] Field of Search ..... 343/806, 702, 700 MS, 343/895, 718, 741–744, 748–750, 752, 867, 870, 866; 336/200; 455/269

[56] References Cited

U.S. PATENT DOCUMENTS

| | | | |
|---|---|---|---|
| 3,231,894 | 1/1966 | Nagai | 343/806 |
| 4,038,662 | 7/1977 | Turner | 343/752 |
| 4,080,585 | 3/1978 | Molthen | 336/200 |
| 4,547,776 | 10/1985 | Bolt et al. | 343/741 |

FOREIGN PATENT DOCUMENTS

| | | | |
|---|---|---|---|
| 134505 | 8/1983 | Japan | 343/742 |

*Primary Examiner*—Eli Lieberman
*Assistant Examiner*—Michael C. Wimer
*Attorney, Agent, or Firm*—Flehr, Hohbach, Test, Albritton & Herbert

[57] ABSTRACT

A compact, lightweight, printed circuit card antenna which is adaptable to a wide range of frequencies, including very low frequencies. The antenna includes a three-dimensional inductor formed on the card, a peripheral conductor stripe on one side of the card which provides a distributed capacitance to the end of the antenna (to cancel inductive effects and broaden its bandwidth), and a peripheral conductor on the opposite side of the card which provides a capacitance to ground (to tune the antenna to frequency), and a transmission line feed point which provides an impedance match to the associated printed circuit flat cable transmission line without the use of impedance matching circuits.

4 Claims, 8 Drawing Figures

MINIATURE RADIO TRANSCEIVER ANTENNA

BACKGROUND OF THE INVENTION

The present invention relates to a compact antenna and, in particular, to a compact lightweight antenna configuration which is adaptable to mobile, hand-held communications devices, including transceivers and including those devices which operate at high frequencies (VLF is considered to about 60 Hz and HF is about 2–30 MHz).

The need for the present invention arises, for example, in response to the continuing development of LSI and VLSI circuits for receivers, transmitters and transceivers. As is frequently the case regarding integrated circuit development, the associated physical hardware, in this case antennas, has not kept pace with the miniaturization of the integrated circuit components. The need which led to the development of the present invention derived from the requirements of a miniaturized hand-held communications terminal which is used in a computer-controlled restaurant or institutional ordering and billing system, or an inventory control system. This hand-held terminal incorporates the antenna of the present invention and is referenced here to illustrate, without limitation, the application and operation of that antenna. The hand-held terminal and the associated institutional/inventory control system are the subject of co-pending U.S. patent application, Ser. No. 655,019, entitled AUTOMATED ORDERING AND ACCOUNTING SYSTEM, filed in the names of Charles P. Thcaker, Frederick J. Scholz and Robert T. Bryant, on the same date as the present application, which application is assigned to the assignee of the present application and is incorporated by reference.

In the recent past, frequent attempts have been made to derive from the dipole antenna small antennas which are suitable for small integrated circuit radio devices (transmitters, receivers, transceivers). Consider first the half-wave dipole antenna 30 shown in FIG. 2. In free space, such an antenna is one piece of wire stretched out the full half wavelength of the frequency of operation. The antenna is fed by a transmission line 31, usually via an insulator 32 inserted in the middle of the wire so that each end of the dipole 33—33 is one-quarter wavelength from the center.

There are a number of approaches for shortening such a dipole antenna by inductive loading. A typical approach involves inserting coils 34—34 in the one-quarter wavelength wire. Inserting an inductance, however, introduces reactance, making it difficult to obtain a good match at the resonating frequency and, thus, requiring compensation for the reactance. It also narrows the bandwidth of the antenna. If the introduced inductance is very small compared to the length of the dipole, the inductive reactance can generally be ignored. However, if the antenna comprises a large percentage of coil and a small percentage of wire, or comprises essentially all coil, then it *is* necessary to compensate for that inductive reactance, and the bandwidth becomes extremely narrow. One approach is to broaden the dipole ends with plates or wires 35, FIG. 2, to provide a capacitive coupling into space at the wire ends.

Referring to FIG. 3, there is illustrated schematically a second type of dipole antenna, a conventional quarter-wave whip antenna 40 which is fed against ground. The coaxial cable transmission line 41 is connected so that its shielded outer conductor is coupled to ground and the internal conductor from the radio or other transmission/receiving device is connected to one end of the straight, one-quarter wavelength antenna wire 42. Such antenna systems are usually mounted on a metal surface or on the ground. The radiated electromagnetic waves are then reflected off the ground or surface and so develop an overall symmetrical pattern of radiation in all directions at a rather low angle of radiation. More importantly, the length of the antenna, $\mathbf{1}_a$, is inversely proportional to frequency, f, and directly proportional to wavelength, $\lambda$. That is, $1_a \propto \lambda \propto 1/f$. As a consequence, at low frequencies $\mathbf{1}_a$ is very long. As is true of the half-wave dipole antenna, the quarter-wave whip antenna can be shortened by inserting an inductor such as a coil 43, in this case at the base. Again, however, the insertion of inductance into the antenna changes the reactance and narrows the bandwidth and at some point it becomes necessary to compensate, for example, by attaching "capacity hats" to the antenna.

The patent literature reflects several approaches which have been utilized in attempting to provide small, lightweight antennas. Illustrative of one of the several approaches, Hooper, U.S. Pat. No. 3,049,711, discloses an omni-directional antenna comprising two tuned coil circuits. The first coil is included in a first tuned circuit with a first capacitance. The second coil is formed on a printed circuit along with a second capacitance and forms the second tuned circuit. The two circuits are resonant at the same frequency.

In relevant part, the Hooper '711 patent is of general interest in teaching (1) the use of a planar printed circuit coil in a tuned oscillator circuit and (2) the use of a printed circuit dielectric board or paper to define a capacitor which is coupled to a planar printed circuit coil.

A second approach for miniaturizing antennas, believed applicable to VHF systems, involves the use of loop antennas. For example, Rennels et al, U.S. Pat. No. 3,736,591, discloses a U-shaped pager antenna which is formed by the walls of the pager housing and functions as an inductive loop antenna to detect the H-field associated with the transmitted electromagnetic signal. Nagata et al, U.S. Pat. No. 4,123,756, also discloses a U-shaped looped miniature radio antenna. In this implementation, the antenna is formed by a conductive lining or a plated film which is formed inside the two major walls and the adjoining end wall of the radio housing. James, Jr. et al, U.S. Pat. No. 3,956,701, discloses a printed circuit antenna construction for a pager in which two, three-dimension, selectively tuned/detuned orthogonal antennas are formed by planar conductor arrays on the opposite sides of a folded printed circuit board.

Still another approach is encompassed in the transceiver dual-mode antenna of Garay et al, U.S. Pat. No. 4,313,119. Garay et al provides a collapsible or foldable whip-type dipole antenna (or a folding meander line dipole antenna) and a U-shaped loop antenna which is formed on the transceiver casing. Extension or unfolding of the dipole antenna element decouples the loop antenna. Upon retracting or folding, the dipole antenna merges with the loop antenna and couples the loop antenna to the transceiver.

None of the above-described antennas and, to our knowledge, none of the existing prior art antennas provide the combination of small size and weight and the ready adaptability to a range of frequencies, including high frequencies, which are necessary to applications such as the communications terminal described herein.

SUMMARY OF THE INVENTION

Consistent with the objectives of achieving small size and weight in an antenna, in one aspect the present invention is embodied in an antenna which comprises a continuous printed circuit coil formed of an array of conductive elements formed on opposite sides of a dielectric sheet or body and interconnected to form a continuous coil having first and second ends; a first peripheral U-shaped conductor formed on one side of the sheet and forming a distributed capacitance with the elements on the sheet and being connected to the second end of the coil to connect the distributed capacitance to the second end of the antenna; and a second peripheral U-shaped conductor formed on the second side of the sheet and at least partially overlapping the first peripheral conductor and forming a capacitance with respect to the overlapping first peripheral conductor; the second peripheral conductor being connected to the first end of the antenna for providing a distributed capacitance to ground. The frequency of the antenna is determined by the length of the coil, the length of the second peripheral conductor, and the capacitance between the overlapping peripheral conductors.

In another aspect, the feed point to the antenna is located at a distance from the ground end which is selected to provide an impedance match with the transmission line.

BRIEF DESCRIPTION OF THE DRAWINGS

The above and other aspects of the invention are discussed in detail with reference to the accompanying drawings in which.

DETAILED DESCRIPTION OF THE INVENTION

Figure 1:
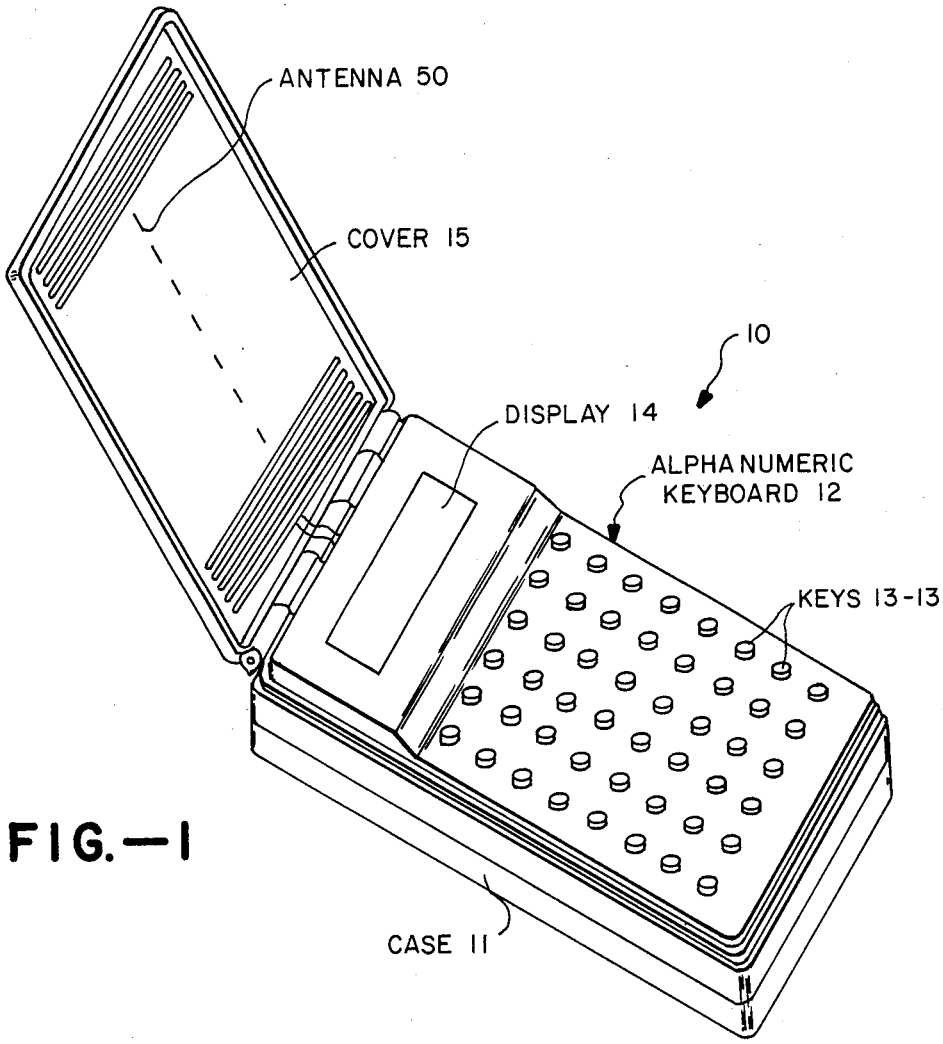
FIG. 1 is a perspective representation of the hand-held communications terminal referenced herein.
Figure 2:
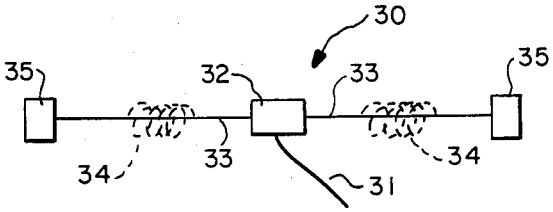
FIG.—2 PRIOR ART
FIGS. 2 and 3 are schematic representations of prior art full-wave and partial-wave dipole antennas, respectively.
Figure 3:
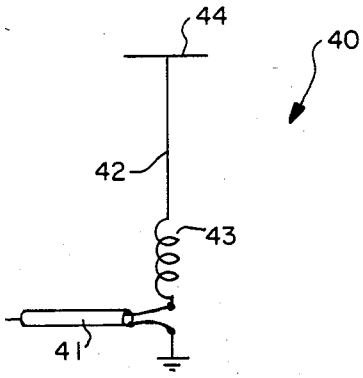
FIG.—3 PRIOR ART

Referring to FIG. 1, the above-mentioned hand-held terminal is designated by the general reference numeral 10. The hand-held terminal 10 is a battery-powered portable unit which in a working embodiment is designed to weigh approximately 1 lb. in a 1" thick×4" wide×7" long configuration. In the restaurant version of the computer-controlled ordering and billing system described in the above-described co-pending U.S. application, the hand-held terminal 10 is designed to be carried by waiters during an entire shift for purposes of communicating order information to a central host computer and responsively displaying verification of the order and other information. The terminal 10 includes a case 11 which mounts an alphanumeric keyboard 12 including individual keys 13—13; a display 14 in the form of a back-lighted liquid crystal display panel; and a hinged cover or closure 15. The case 11 also mounts the associated electronics and the power supply, typically in the form of a battery pack.

Despite the small size and weight required in such a hand-held terminal, the control, display and transceiver functions of the hand-held terminal require a microcomputer, a radio circuit board, the alphanumeric keyboard, the lighted liquid crystal display 14 and the power supply. The radio board includes a modulator circuit which converts the digital voltage output pulses from the microcomputer into shaped signals and passes the signals to a transmitter. The transmitter is crystal controlled and transmits 100 mW of power, frequency modulated, at 27 MHz. Because of these functional and equipment requirements, and the hand-held, mobile operation of the communications terminal 10 and despite the relatively low transceiver frequencies, a large, heavy antenna is simply unacceptable.

Due to FCC regulations, the frequencies which allow the maximum flexibility in power and configuration for terminal 10 with minimum interference from outside sources are 26.995 to 27.195 MHz. There are five channels with 10,000 uV/M at three meters and 20 KHz bandwidth allowed. However, the natural wavelength in an antenna operating at 27 megahertz is about 11 meters; consequently, the existing antennas for this frequency are physically quite large. The smallest of these is a coil antenna about 18 inches long and over one-half inch in diameter (popularly known in CB circles as a "rubber duck"). The problem with using this CB antenna is how to fit it into the package 10 and have it concealed in the available space, and yet efficiently radiate. If it is packaged adjacent to the printed circuit cards and wiring inside the hand-held terminal, it won't radiate. In addition, even this antenna is simply too large and heavy and obtrusive for convenient continuous use such as in a terminal 10 used by a restaurant waitstaff.

Figure 5:
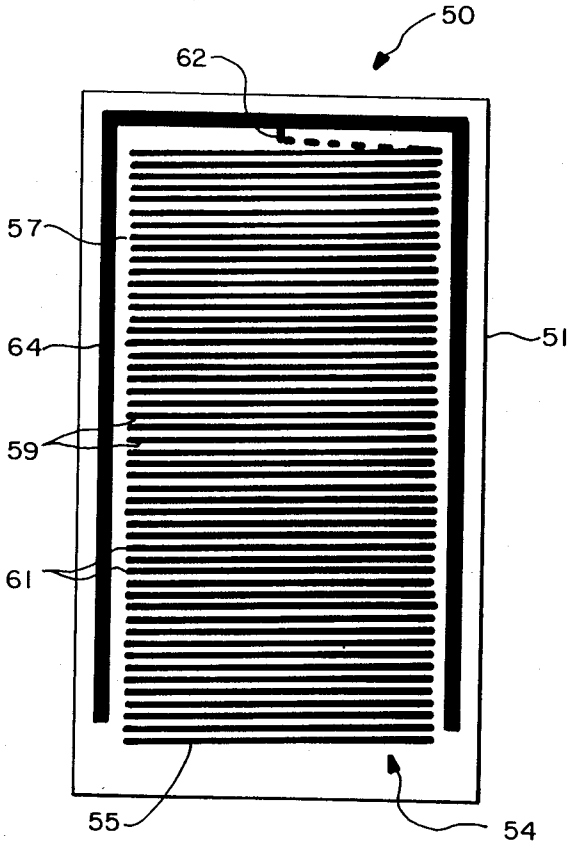
FIGS. 4 and 5 are opposite side views of one embodiment of the antenna of the present invention.
Figure 4:
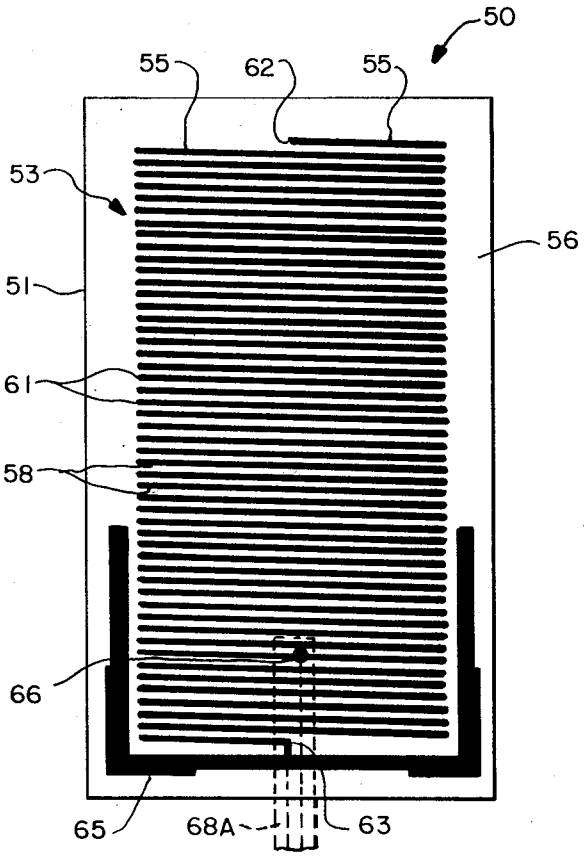
Figure 6:
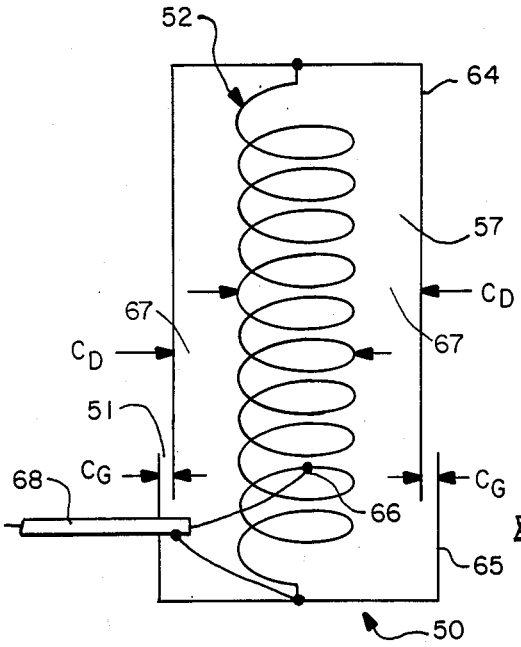
FIGS. 6 and 7 are simplified schematic representations of the antenna of FIGS. 4 and 5 illustrating different transmission lines.

FIGS. 4 and 5 illustrate opposite side views of one embodiment of the antenna 50 of the present invention which meets the above-discussed size and weight requirements, even in low frequency systems. The antenna 50 is formed on a printed circuit board 51 measuring approximately three inches by six inches. The material of the printed circuit board is 0.030 inches thick FR G-10 glass epoxy. Other dielectric materials will work also. Both flexible and rigid dielectric sheets 51 can be used. The antenna 50 is in effect the extreme case of the above discussed one-quarter wave whip dipole antenna in that the antenna is substantially all coil. The coil 52 (FIG. 6) comprises two patterns 53 and 54 of parallel copper conductors 55 formed of one ounce copper, 0.1 inches wide and approximately 250 inches long on opposite sides 56 and 57 of the printed circuit board 51. The conductors or stripes 55 of pattern 53 are oriented at a slight angle relative to the corresponding conductors of pattern 54 so that the ends 58 and 59 of the respective opposite-side conductors are aligned. Plated through-holes 61—61 connect the aligned ends. As the result of this construction, the conductor patterns 53 and 54 and the connecting plated-through holes 61—61 define on the three-inch by six-inch printed circuit board 51 a very compact, long, multiple-turn, continuous three-dimensional coil. In the illustrated embodiment, the coil contains forty-nine turns and a conductor length of 250 inches between ends 62 and 63. This length plus the length of the stripe 64 and the overlap of conductors 64 and 65 satisfy the dimensional requirements for the 27 MHz frequency used in the mobile hand-held terminal 10.

The antenna 50 also comprises 0.125 inches wide U-shaped continuous peripheral copper conductor 64 formed on printed circuit board side 57, connected to end 62 and spanning essentially the entire length of the long sides of the printed circuit board and the adjoining end. The antenna also includes a shorter, U-shaped peripheral copper conductor 65 which is also 0.125 inches wide and is formed along the sides and adjoining end of the opposite printed circuit board surface 56 connected to the opposite, ground end 63 of the coil.

As mentioned previously, one prior art approach for adding the necessary capacitive reactance to coil or coil-containing antennas is to broaden the dipole ends with plates or wires. The lack of space makes such an approach simply unavailable for the present antenna. Instead, the problem of capacitive reactance is solved by the conductor 64. That is, in the present invention and referring to FIG. 6, the U-shaped conductor 64 is connected to the end 62 of the antenna that is not fed (i.e., the end opposite feed point 66) and forms capacitance $C_d$ with the intervening dielectric regions 67 of the printed circuit board and the closely spaced conductors of pattern 54. $C_d$ is, thus, a distributed capacitance, which provides the necessary compensation for the inductive effect of the essentially all-coil antenna 50.

In addition, the requisite capacitance to ground is provided by the typically shorter U-shaped conductor 65 which is connected to ground at end 63. This lumped capacitance to ground, $C_g$, is provided by the conductor 65; the correspondingly shaped and positioned conductor 64 on the opposite side of the printed circuit board which overlaps 64 at the ends thereof; and the intervening dielectric 51 between the overlapping conductors.

Figure 7:
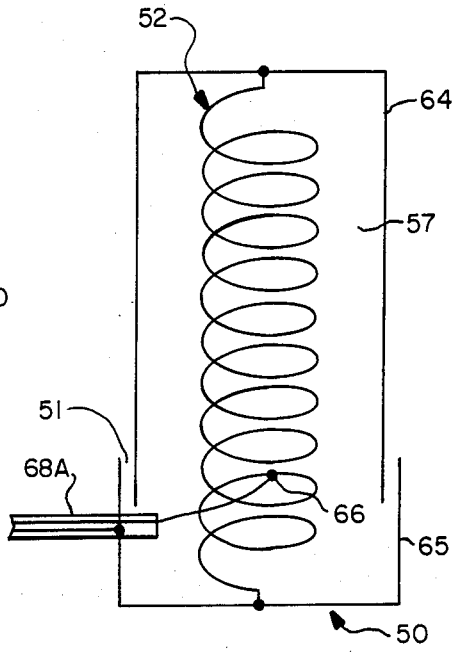

The antenna 50 also employs a novel approach for providing the necessary impedance match to the transmission line such as a coaxial cable 68 (FIG. 6) or the flexible printed circuit 68A (FIG. 7) which connects the antenna to the radio circuit. The resistance of a conventional quarter-wave dipole antenna when fed at the base with a good ground and proximity of the antenna to the base, is approximately 50 ohms. A 50 ohm coaxial cable is commonly available and used. However, as the antenna space is loaded with increasing amounts of inductance, as is the case for antenna 50, the resistance of the feed point decreases. A typical value for a shortened antenna with a coil at the base is about 20 to 25 ohms. One way to compensate for the decreased resistance and provide the match to the coaxial cable is to incorporate a reactive circuit which is adjusted by variable capacitive and inductive elements so that the base of the antenna 10 connected through the tunable circuit to the coaxial cable.

In the present invention, using conductor 68A (FIG. 7) the necessary resistance, typically 50 ohms but variable as necessary for the required match, is obtained by grounding the base of the antenna at 63 and feeding the flat flexible printed circuit 68A to a tap or feed point 66 which is moved up the antenna as necessary along the inductance to provide the necessary resistance.

In the illustrated embodiment, the feed point 66 is spaced approximately 25 inches from 63. This gives the required 50 ohms match, a minimum standing wave ratio and good power transfer to the antenna.

Figure 8:
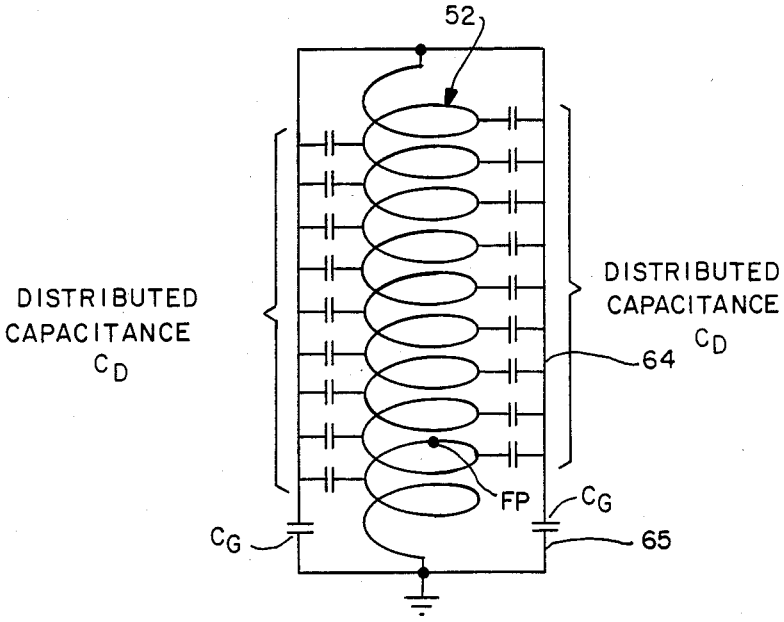
FIG. 8 is a schematic representation of the effective electrical components provided by the physical construction of the antennas of FIGS. 4 and 5.

FIG. 8 is a circuit schematic which illustrates the electrical circuit elements which are formed by the physical printed circuit board construction of antenna 50, including coil 52, distributed capacitance $C_d$ and lumped capacitance to ground, $C_g$.

It should be noted that increasing the width of the conductors or stripes 55 decreases the number of conductors available in a given area and, thus, increases the frequency. Otherwise, varying the width or thickness of the individual conductor stripes has little effect on the antenna performance.

Increasing the thickness of the printed circuit board 51 increases the thickness of the dielectric material between the capacitive elements of the circuit and therefore reduces the capacitance in the antenna and causes the frequency to rise. I.e, $f \propto t$, where t is the thickness of the dielectric sheet material 51. This capacitance effect would be offset when taken to the limits. Also, as the board is made thicker, the increased length of the conductor necessary to conduct from one side of the board to the other causes the frequency to shift in the other direction, because antenna length and frequency are inversely related. I.e., $l_a \propto 1/f$.

As mentioned, applications such as the mobile hand-held terminal 10 require an efficient radiator or antenna which takes up minimum space in the package. The antenna 50 is configured as a flat antenna on a printed circuit board which fits in the lid 15 of the hand-held terminal 10. When the lid is open, the antenna is positioned generally upward and away from the electronics in the terminal and from the operator's hand to provide good reception and good transmission.

Obviously, the present antenna is not limited to use in the terminal 10. In fact in the system which utilizes the hand-held terminal, the antenna is also used in a radio base station which communicates with the terminal. In this or other applications, the antenna is sufficiently small and unobtrusive to be located in the middle of the room, yet is quite easily camouflaged because of its size and shape. The antenna is also readily scalable by the simple expedient of changing dimensions.

To summarize several key features of the present antenna 50, the inductance of this compressed printed circuit antenna is balanced by suitable capacitance built into the printed circuit board. The capacitance is distributed over the entire antenna by running printed circuit stripes along the edges of the antenna, providing resonance over a broad range of frequencies. There is some lumped capacitance in order to make the antenna most efficient in and tunable to the desired channels (five available channels in the case of the 27 MHz).

Also, the impedance match is accomplished by grounding one coil end and feeding RF power in at a point which is selectively spaced from that end to provide the necessary impedance match. As a consequence, the antenna can be fed with and matched to any other readily available types of coaxial cables, without a matching network.

Generally, the length of conductor in a helically wound antenna is approximately one-half a wavelength or slightly longer. Thus, the antenna 50 is empirically tuned to the desired frequency by utilizing an initial half wavelength or slightly longer dimension, and applying frequency measuring devices to adjust increments of length to the half wavelength. Specifically, the length of the conductor of the present antenna 50 was first tried at approximately one-half wavelength, and then adjusted to the proper length by the use of a solid-state "dip" meter and a spectrum analyzer to calibrate the frequency. The frequency was increased or decreased as necessary by adding or removing short conductor segments to the ends of element 65 to change the overlap capacitance with conductor 64 (a one-quarter inch change in length approximates 500 cycles).

Finally, it should be mentioned that although the present antenna was developed to a specific size to a specific purpose, the same general principles can be applied to the construction and tuning of essentially any frequency antenna below the UHF region, including frequencies lower than 27 MHz. The antenna can be mounted on roof tops, walls, windows, and in a variety of other places. As an example of other dimensions, a typical 40 meter half-wave dipole is 65 feet in length, whereas a 40 meter antenna 50 could be formed on a six inch by twelve inch rectangular printed circuit card.

Having thus described a preferred and alternative embodiments of the present invention, what is claimed is:

1. An antenna comprising: a dielectric sheet; a first conductor pattern formed on a first side of the sheet; a second conductor pattern formed on the second, opposite side of the sheet and aligned with and connected to corresponding conductors of the first pattern to thereby define a coil having first and second ends, the second end being for connection to ground; a first peripheral conductor formed on the first side of the sheet about a selected length of the periphery of the sheet and connected to the first end of the coil for defining a distributed capacitance with respect to the adjacent conductor pattern; and, a second peripheral conductor formed on the second side of the sheet about a selected length of the periphery of the sheet and being connected to the second, ground end of the coil for defining a capacitance with respect to the first peripheral conductor to provide a capacitance to ground.

2. An antenna comprising: a dielectric sheet; a first conductor pattern formed on a first side of the sheet; a second conductor pattern formed on the second, opposite side of the sheet and aligned with and connected to corresponding conductors of the first pattern to thereby define a coil having first and second ends, the second end being for connection to ground; a first peripheral conductor formed on the first side of the sheet about a selected length of the periphery of the sheet and connected to the first end of the coil for defining a distributed capacitance with respect to the adjacent conductor pattern; a second peripheral conductor formed on the second side of the sheet about a selected length of the periphery of the sheet and being connected to the second, ground end of the coil for defining a capacitance with respect to the first peripheral conductor to provide a capacitance to ground; and wherein the coil is connected via a transmission line to a transmission or receiving circuit at a point on the coil spaced a selected distance along the coil from the second, ground end to provide an impedance match with the transmission line.

3. An antenna, comprising: a continuous printed circuit coil comprising a continuous array of conductive elements formed on opposite sides of a dielectric sheet and interconnected to form a continuous three-dimensional coil having first and second ends, the first end being suitable for connection to ground; a first peripheral U-shaped conductor formed on one side of the sheet and forming a distributed capacitance with the elements on that side of the sheet, the first conductor being connected to the second end of the coil to connect the distributed capacitance to the second end of the coil; and a second peripheral U-shaped conductor formed on the second side of the sheet and partially overlapping the first peripheral conductor to form a capacitance with respect to the first peripheral conductor; the second conductor being connected to the first end of the coil for providing a lumped capacitance to ground.

4. The antenna of claim 3 wherein the frequency response of the antenna is determined by the length of the coil and the length of the second peripheral conductor combined with the magnitude of the capacitance to ground.

* * * * *